US010836061B2

(12) United States Patent
Fisher

(10) Patent No.: US 10,836,061 B2
(45) Date of Patent: Nov. 17, 2020

(54) SELF-DEFENSE DEVICE

(71) Applicant: Jodi Sheryl Fisher, Tucson, AZ (US)

(72) Inventor: Jodi Sheryl Fisher, Tucson, AZ (US)

( * ) Notice: Subject to any disclaimer, the term of this patent is extended or adjusted under 35 U.S.C. 154(b) by 0 days.

(21) Appl. No.: 14/678,926

(22) Filed: Apr. 3, 2015

(65) Prior Publication Data

US 2016/0286910 A1 Oct. 6, 2016

(51) Int. Cl.

| | |
|---|---|
| ***B26B 27/00*** | (2006.01) |
| ***B26B 29/00*** | (2006.01) |
| ***F41B 13/00*** | (2006.01) |
| ***A44C 9/00*** | (2006.01) |

(52) U.S. Cl.

CPC ..... *B26B 27/007* (2013.01); *A44C 9/0061* (2013.01); *B26B 29/00* (2013.01); *F41B 13/00* (2013.01)

(58) Field of Classification Search

CPC ..... B26B 27/007; B26B 29/02; B26B 27/00; B26B 21/527; B27B 27/002; A61B 2007/32116

USPC ..... 30/298, 348, 232, 291

See application file for complete search history.

(56) References Cited

U.S. PATENT DOCUMENTS 78,887 A * 6/1868 Morse et al. ..... B26B 9/00 30/348
197,857 A * 12/1877 Jameson ..... B26B 27/007 30/298
203,978 A * 5/1878 Woods ..... A01G 3/00 2/21
288,096 A * 11/1883 Morgan ..... B26B 13/20 30/232
421,665 A * 2/1890 Buchman ..... B26B 27/007 2/21
488,945 A * 12/1892 Nelson ..... A47L 13/19 30/298
519,999 A * 5/1894 Godbey ..... B26B 13/20 30/232
784,421 A * 3/1905 Painter ..... B26B 27/007 30/291
814,080 A * 3/1906 Reed ..... B26B 27/007 30/298

(Continued)

FOREIGN PATENT DOCUMENTS

CA 2125721 A1 * 12/1995 ..... B26B 27/007
CH 149157 A * 8/1931 ..... B26B 27/007

(Continued)

OTHER PUBLICATIONS

English translation of DE29620070. (Year: 1997).*

*Primary Examiner* — Jennifer B Swinney
(74) *Attorney, Agent, or Firm* — Hayes Soloway P.C.

(57) ABSTRACT

A self-defense device generally comprises a wearable piece of jewelry, such as a ring, that comprises an integrated blade element. The ring comprises an inner diameter sized to accommodate a user's finger or the ring may receive size inserts to effectively reduce the ring's inner diameter so as to accommodate a size of the user's finger. The blade may be serrated, barbed, hooked, and the like to provide for a more effective device. The blade may comprise various supports to add rigidity; may be contoured to accommodate the form of the user's finger; and may comprise a sheath to secure the blade during non-use. The self-defense device may also comprise multiple rings secured together to provide for multiple blades.

19 Claims, 5 Drawing Sheets

(56) References Cited

U.S. PATENT DOCUMENTS 824,925 A * 7/1906 Gosnell ..... D05B 91/04 30/162
864,812 A * 9/1907 Thuillier ..... B26B 9/00 30/348
885,569 A * 4/1908 Bergquist ..... B26B 27/007 294/25
1,300,521 A * 4/1919 Villiger ..... B26B 27/007 30/291
1,324,672 A * 12/1919 Hempel ..... B26B 5/001 30/162
1,365,952 A * 1/1921 Raymer ..... B26B 27/007 30/161
1,536,752 A * 5/1925 Beatty ..... B26B 27/00 30/291
1,599,126 A * 9/1926 Freeman ..... B26B 27/007 30/291
1,643,336 A * 9/1927 Frost ..... A47L 17/06 15/236.07
2,533,105 A * 12/1950 Groff ..... A41H 31/005 30/298
2,555,735 A * 6/1951 Estabrooks ..... B26B 9/02 30/355
2,989,807 A * 6/1961 Florence ..... B26B 11/00 30/151
3,457,643 A * 7/1969 Hill ..... B26B 29/02 30/293
3,587,591 A * 6/1971 Satterwhite ..... A61B 17/4208 30/298
4,797,974 A * 1/1989 Smith, Jr. ..... A22C 25/06 294/25
5,301,432 A * 4/1994 Richardson ..... B26B 27/007 30/291
5,588,214 A 12/1996 Nelson
6,123,228 A 9/2000 Hippensteel
6,126,040 A 10/2000 Hippensteel
6,135,321 A 10/2000 Hippensteel
7,036,262 B2 * 5/2006 Yabusaki ..... A01K 95/02 294/25
2005/0193565 A1 * 9/2005 Knowles ..... B26B 27/007 30/155
2010/0251552 A1 10/2010 Gazcon et al.
2012/0192434 A1 * 8/2012 Syrjala ..... B26B 1/08 30/162
2012/0304471 A1 * 12/2012 Jones ..... B26B 27/007 30/162
2014/0208594 A1 * 7/2014 Scimone ..... B67B 7/30 30/2
2014/0259694 A1 * 9/2014 Oldham ..... B26B 27/007 30/298
2015/0075013 A1 * 3/2015 Novak ..... B23D 61/123 30/348

FOREIGN PATENT DOCUMENTS

CH 375249 A * 2/1964 ..... B26B 27/007
DE 29620070 U1 * 2/1997

* cited by examiner

SELF-DEFENSE DEVICE

FIELD OF THE INVENTION

The present disclosure generally relates to self-defense devices, more particularly, the self-defense device is directed towards a piece of wearable jewelry, such as a ring comprising a blade.

BACKGROUND OF THE INVENTION

Securing the personal safety of one's self, family, friends and/or property is an ever mindful consideration. To that end, many choose various ways to protect themselves from exploitation by others, where such exploitation may be a physical attack, mugging, rape, unwanted detainment, burglary, etc. However, the many ways that a person may choose to protect themselves often has many disadvantages. For example, a person may rely upon a firearm, pepper spray, knife or other deterrents in an attempt to protect themselves. During an attack though, a user rarely has the opportunity to retrieve and operate such items from whatever manner they are carrying or storing the item; e.g., from a purse, a storage case, a bag, a safe, a glove box, etc. Moreover, circumstances may dictate that at times the person may not even have the means to transport their self-defense item. For example, a person may be exercising by hiking, jogging, running, and the like, which does not lend itself to carrying such self-defense items.

What is needed and disclosed is a self-defense device configured to operate as an effective deterrent, is readily accessible, and can be easily transported.

SUMMARY OF THE INVENTION

Among various representative embodiments, a self-defense device generally comprises a wearable piece of jewelry, such as a ring, that comprises an integrated and/or suitably coupled blade. The ring comprises an inner diameter and/or opening sized to accommodate the finger size of a user, but in other embodiments the ring may be configured to receive an insert that effectively reduces the inner diameter and/or opening of the ring so as to accommodate the finger size of the user.

Among various representative embodiments, the self-defense device may comprise various blades having various configurations such as serrated edges, barbs, hooks, and the like, as well as comprise various shapes, such as a contoured blade to conform to the curved shape of the user's finger. The blade may be integrated with the ring to provide a one-piece configuration or may be removable so as to provide for interchangeability among a variety of blade types, or other defense items.

Among various representative embodiments, the self-defense device may further comprise a sheath to secure the blade during non-use. The blade may comprise supports to provide for greater rigidity of the blade. The blade may be hinged and/or pivotable to accommodate various detent angles for various attacking modes. The blade may also be retractable.

Among various representative embodiments, a self-defense device may comprise multiple rings to provide for a multi-blade configuration, and the device may be configured to receive a coupling mechanism to secure the multiple rings together.

Finally, among various representative embodiments, a self-defense device may comprise a method for manufacturing, packaging, marketing, distributing, and/or selling the self-defense device.

BRIEF DESCRIPTION OF THE DRAWINGS

A more complete understanding of a self-defense device may be derived by referring to the following detailed description and appended claims when considered in connection with the following illustrative Figs. In the following Figs., like reference numbers refer to similar elements and steps throughout the Figs.

Elements and/or any steps in the Figs. are illustrated for simplicity and clarity and have not necessarily been rendered according to any particular assembly and/or sequence of operation. For example, any method steps may be performed concurrently or in different order are illustrated in the Figs. to help improve an understanding of exemplary embodiments of a self-defense device. Similarly, illustrated components may be assembled and/or constructed in various configurations using shown or comparable elements to help also improve an understanding of exemplary embodiments of a self-defense device.

DETAILED DESCRIPTION OF THE INVENTION

A self-defense device may be described herein by terms of various functional system elements and/or various method steps. Such functional elements may be realized by any number of hardware components configured to perform specified functions and achieve various results. For example, a self-defense device may employ and/or engage various blades, sheathes, rings, fittings, supports, and the like, which may carry out a variety of functions. In addition, the self-defense device may be practiced in conjunction with any variety of self-defense applications, whether traveling, commuting, exercising, for sport, etc.; and any devices described are merely exemplary applications. The self-defense device described and claimed herein may also be applied to other wearable items, such as bracelets, anklets, necklaces, arm bands, belts, and the like. Further, the self-defense device may employ any number of conventional techniques for manufacturing, packaging, marketing, distributing, and/or selling the self-defense device.

Figure 1:
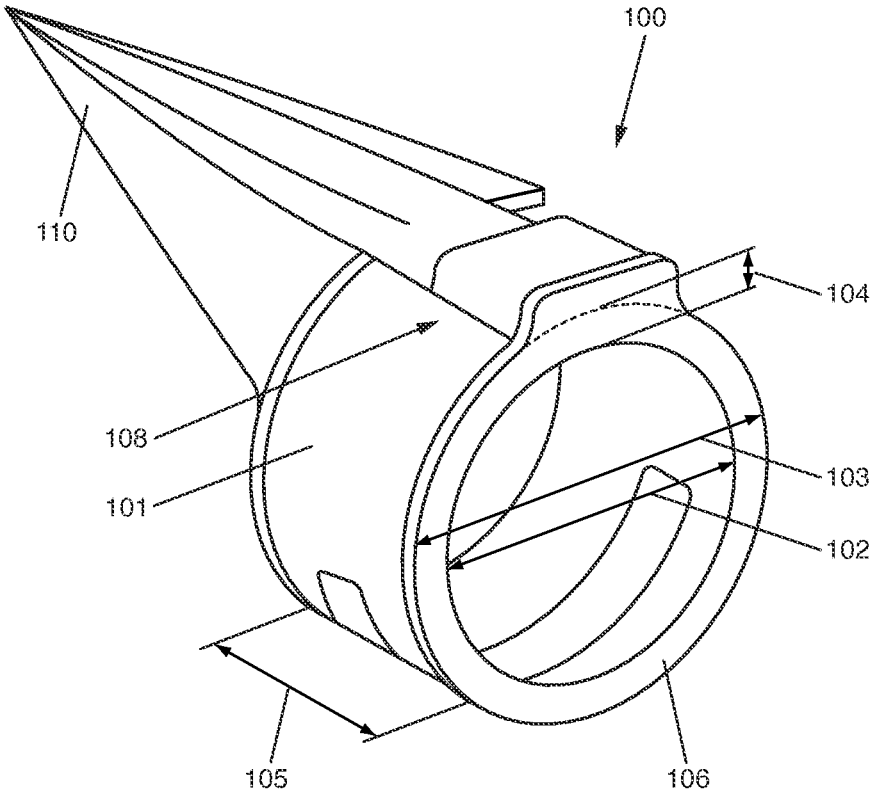
FIG. 1 representatively illustrates a perspective view of an exemplary embodiment of a self-defense device.

Referring now to FIG. 1, an exemplary embodiment of a self-defense device 100 may comprise a wearable piece of jewelry, such as a ring. In simplest form, ring 100 comprises a wearable ring portion 101 and a blade portion 110. As is apparent, ring portion 101 is worn on a finger of a user and in the event of a conflict, the user has a self-defense device that is readily available, effective, and easily transported.

Figure 2:
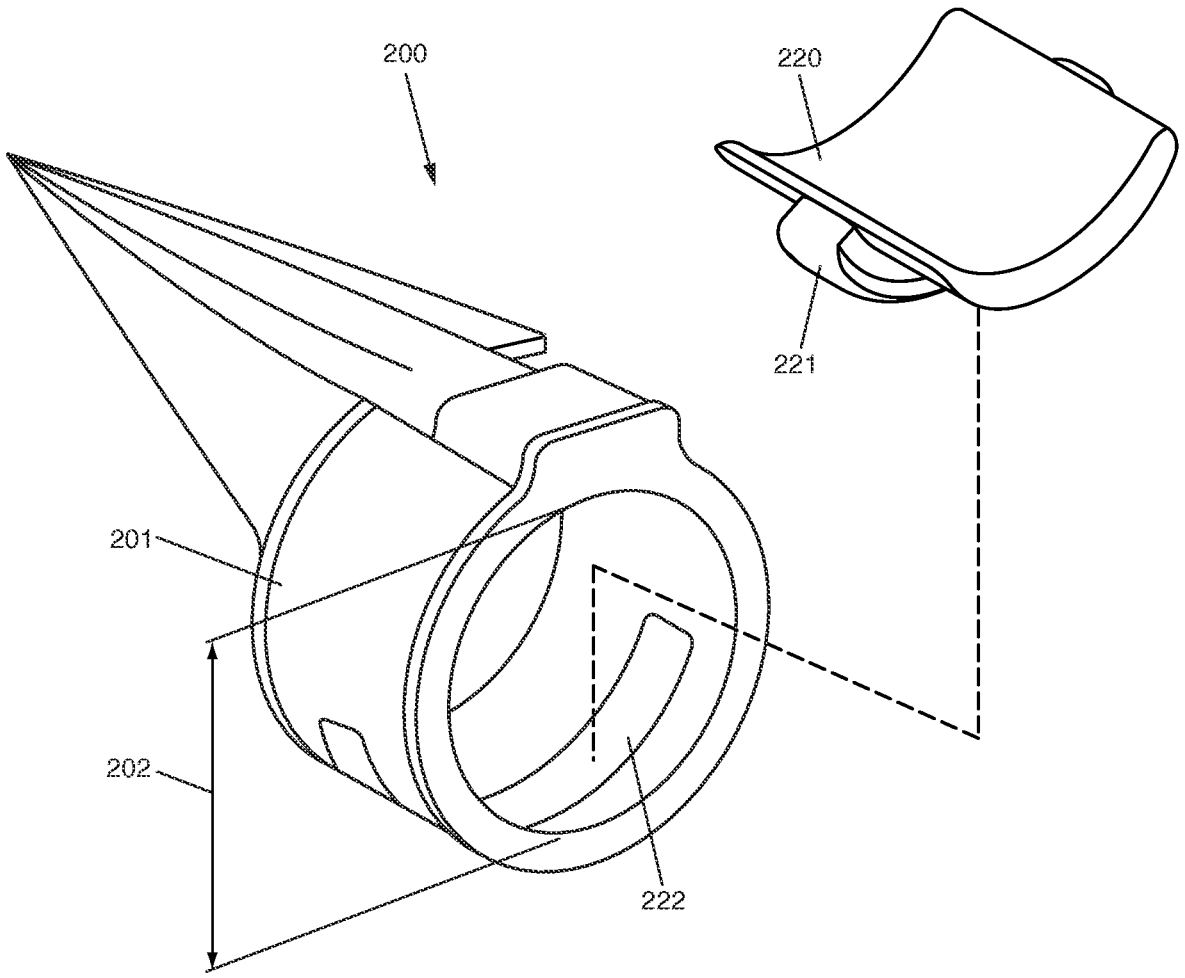
FIG. 2 representatively illustrates a perspective exploded view of another exemplary embodiment of a self-defense device.

Continuing with the exemplary embodiment, ring portion 101 comprises an opening, such as an inner diameter 102, having a size to accommodate the finger size of a user. Ring portion 101 further comprises an outer diameter 103, and the distance between inner diameter 102 and outer diameter 103 defines a thickness 104 of ring portion 101. In general, inner diameter 102 and outer diameter 103 are consistent along a width 105 of ring portion 101 such that thickness 104 is likewise consistent along width 105, but in some embodiments, outer diameter 103 and maybe even inner diameter 102 may vary along width 105 such that thickness 104 may likewise vary. Such a varying diameter and thickness configuration may be beneficial depending on the desired configuration and/or design of ring portion 101. As disclosed, ring portion 101 comprises inner diameter 102 having a size to accommodate the finger size of a user, however, it will be appreciated by those skilled in the art that ring portion 101 may be altered to accommodate the finger size of the user in an alternate fashion. Rather than directly sizing ring portion 101 to accommodate the user's finger size, ring portion 101 may be configured to receive a size insert to effectively reduce the opening and/or inner diameter 102 of ring portion 101 so as to accommodate the user's finger size. For example, and with reference to FIG. 2, sizing inserts 220 are illustrated. In this exemplary embodiment, a sizing insert 220 comprise a tab 221 integrated with sizing insert 220 and configured to be received by a mating slot 222 of ring portion 201. In this manner, sizing insert 220 may be secured within ring portion 201 and effectively reduce the opening and/or inner diameter 202. It will be appreciated by those skilled in the art though, that other sizing insert configurations as well as other mechanisms for securing such sizing insert may be used. For example, sizing insert 220 shown only spans a portion of an inner circumference of ring portion 201, but other embodiments may employ a sizing insert that encompasses the entirety of the inner circumference of ring portion 201. Moreover, while a tab/slot configuration is depicted to demonstrate securing sizing insert 220 within ring portion 201, other securing mechanisms may be employed, such as, glues, snaps, welds, friction fits, and other like securing mechanisms generally known in the securing art.

It should be noted that an inner diameter and an outer diameter referred to throughout the specification may vary about a respective inner and outer circumference of any of the embodiments disclosed, and those skilled in the art understand that such variations do not detract from the overall scope and spirit of the self-defense device. For example, because sizing insert 220 shown spans only partly about an inner circumferential portion of ring portion 201, insert 220 may alter an inner diameter of ring portion 201 in only that area, thus it may not alter an inner diameter in another part. Whereas a sizing insert that spans the entire inner circumference of ring portion 201 would alter the entirety of ring portion 201's inner diameter. Thus, when a sizing insert is referenced and discussed how it may reduce the effective inner diameter of ring portion 201, it should be understood that such insert similarly reduces the inner circumference and/or overall ring size opening of ring 200 so as to accommodate the size of a user's finger.

Figure 3:
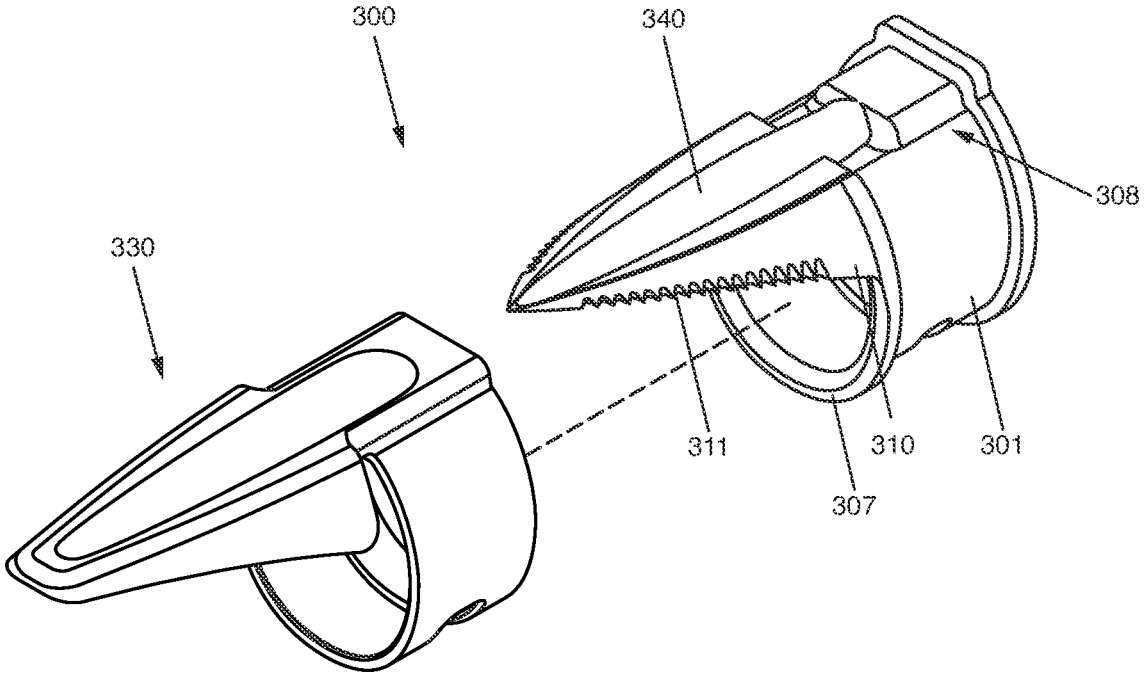
FIG. 3 representatively illustrates a perspective exploded view of an exemplary embodiment of the self-defense device.

Continuing with exemplary embodiments shown by the FIG. 1 as well as FIG. 3, ring portion 101 comprises a proximate circumferential perimeter, best seen by 106 of FIG. 1 and a distal circumferential perimeter, best shown by 307 of FIG. 3. In an exemplary embodiment, a blade 310 is affixed to and extends from at least a portion of distal circumferential perimeter 307 of ring portion 301, as shown in FIG. 3. In an embodiment, blade 310 is integral to ring portion 301 and extends substantially normal to distal circumferential perimeter 307. Moreover, blade 310 not only extends outwardly from distal circumferential perimeter 307, but is also integral to a top width portion 308 of ring portion 301, to provide additional stability and support for blade 310. While in this embodiment blade 310 is integral with ring portion 301 at distal circumferential perimeter 307 and top width portion 308, those skilled in the art will appreciate that other blade embodiments may be employed. For example, other embodiments may comprise a blade to be integral more completely with an outer circumferential, top width portion of ring portion 301, or a blade could extend from an outer circumferential, side width portion or bottom width portion of ring portion 301. Still yet, another embodiment might employ more than one blade, for example, ring portion 301 may comprise one blade on one outer circumferential, side width portion and a second blade on an opposite outer circumferential, side width portion, or any combination thereof between top, bottom, and side outer circumferential width portions. And even still yet, any of the above embodiments may be integral and/or couple to an inner circumferential, width portion and/or part or all of a distal circumferential perimeter.

In accordance with the present embodiment, blade 310 is depicted as an integral element of ring portion 301, but in other embodiments a blade may be detachable from ring portion 301. For example, some embodiments may provide for interchangeable self-defense elements and/or other blade configurations or types. Moreover, blade 310 may not comprise a static position, i.e., the extended normal configuration with respect to distal circumferential perimeter 307, but rather may be affixed at varying angles, or may be hinged to accommodate setting the blade at various discrete detent positions, and the like.

It will be understood by those skilled in the art that any ring portion may comprise any ring type known in the jewelry arts. Any ring portion may comprise any of a variety of shape/design configurations and comprise various types of materials, whether natural or synthetic. For example, any ring portion may comprise gold, silver, platinum, aluminum, steel and any other metallic type material, and such metallic materials may be alloyed. Moreover, any ring portion may comprise synthetic materials, for example, various types of thermoplastics, but preferably a thermo-set type plastic. Any ring portion may comprise various types of wood materials, glass, etc.

Similarly, it will be understood by those skilled in the art that any blade portion may comprise any blade type known in the blade arts. Any blade portion may comprise any of a variety of shape/design configurations and comprise various types of materials, whether natural or synthetic. For example, any blade portion may comprise steel, iron, aluminum, titanium, and any other metallic type material, and such metallic materials may be alloyed. Moreover, any blade portion may comprise synthetic materials, for example, various types of thermoplastics, but also preferably a thermo-set type plastic. Any blade portion may comprise various types of wood materials, glass, etc.

In accordance with an embodiment of the self-defense device, and with continuing reference to FIG. 3, self-defense device 300 may comprise a blade 310 comprising serrated blade edges 311. While blade 110 of FIG. 1 comprised a straight blade edge, which is consistent with a slicing use, serrated edges 311 of blade 310 is more consistent with a cutting/sawing use; however, both configurations should be construed as an effective deterrent from an attack. Those skilled in the art will also appreciate that a blade is not restricted by either one of these two forms, and any number of blade configurations are contemplated by this disclosure. For example, other blade embodiments may comprise barbs, hooks, gaffs, etc. and/or any combination thereof. In accordance with the embodiment of the self-defense device, both blade 110, FIG. 1, and blade 310, FIG. 3, depict the blade as being somewhat curved along the length of the blade so as to completely or somewhat conform to the contour, i.e., rounded nature, of the user's finger. Those skilled in the art, though, will appreciate that other blade configurations may be employed. For example, a blade may be straight along its length, or it may be curved in an upward fashion; the blade may also be wavy, tapered, squared, bulging, and any other regular or irregular geometric configuration. A blade may also vary in thickness and width along its length. And the blade may vary in length as well.

Continuing with the exemplary embodiment, and depicted by FIG. 3, a sheath 330 may be employed by the user to secure blade 310 during non-use. Sheath 330 may be configured to secure part or all of blade 310, as well as all or part of ring portion 301. Sheath 330 may be made in a manner consistent with and from materials generally known to those in the sheath making arts. It should be further understood by those skilled in the art that sheath 330 is configured for easy and quick removal, so that at the onset of a conflict or apparent danger, the user can easily and quickly expose the sheathed blade. For example, and in the exemplary embodiment depicted, sheath 330 secures blade 310 and ring portion 310 via a friction fit, but other embodiments may employ various tabs, clips, springs, locks, and the like. In an alternate embodiment, sheath 330 may not be completely removable at all, but rather comprise a polyurethane type material or other material that is flexible and may merely fold back or to one side to reveal a blade.

Continuing with an exemplary embodiment, self-defense device 300 may comprise a support 340 that is integral with and extends along at least a top side portion of a length of blade 310. Support 340 is configured to provide additional support, stability, and/or rigidity of blade 310. As mentioned, it may extend along at least a top side portion of a length of blade 310, but in other embodiments support 340 may extend onto ring portion 301 as well. Support 340 may also extend along any side portions of blade 310 or underneath blade 310, and perhaps extend into the inner portion of ring portion 301. Support 340 may comprise various geometric configurations and comprise various materials. Support 340 may also be removable and/or interchangeable.

Figure 4:
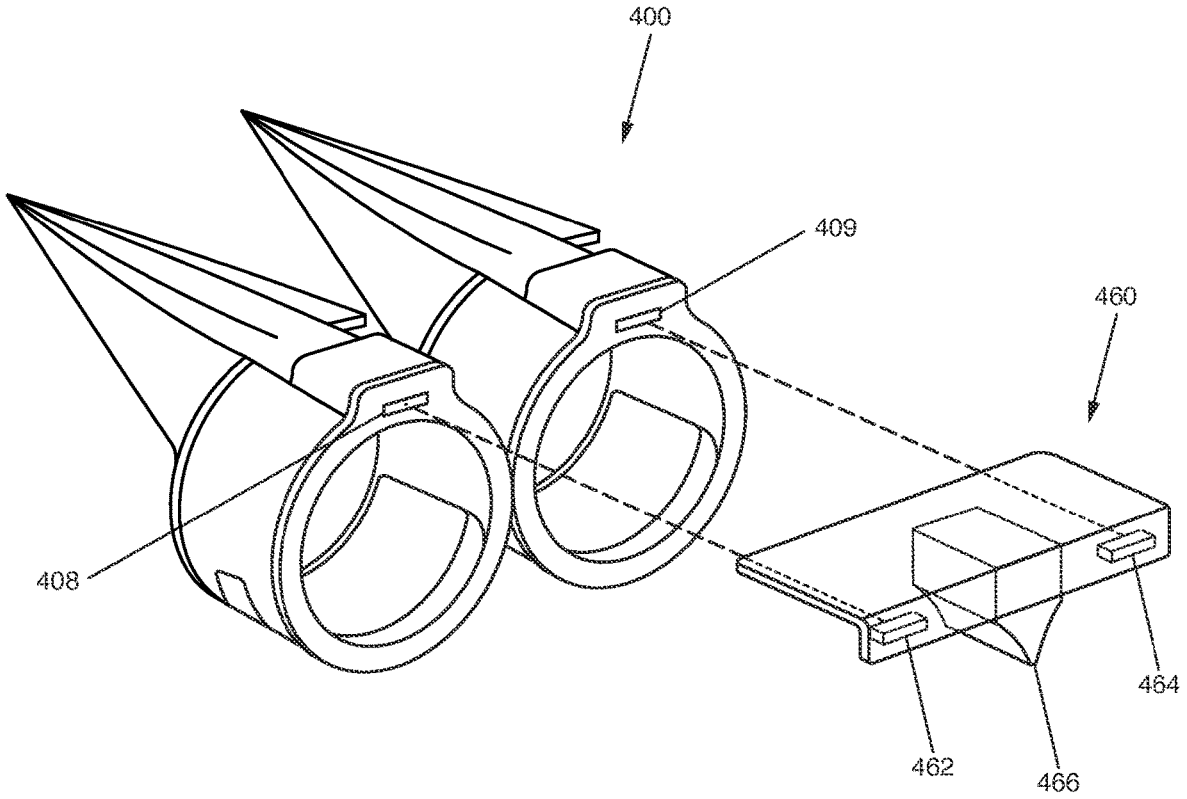
FIG. 4 representatively illustrates a perspective exploded view of yet another exemplary embodiment of a self-defense device.

In accordance with an exemplary embodiment, and with reference to FIG. 4, a multi-ring defense device 400 is depicted. In this exemplary embodiment, a side by side ring configuration is depicted, but other multi-ring configurations may be employed, for example, to accommodate three, four, or perhaps even all five fingers of a user's hand. In the depicted configuration, a clip 460 comprises tabs 462 and 464 that may be received by respective slots 408 and 409 at a proximate perimeter of each respective ring portion so as to couple the self-defense devices together. Clip 460 further comprises a clip brace 466 to further secure the side by side configuration of self-defense device 400. Those skilled in the art will appreciate that the configuration depicted is merely one exemplary embodiment and various other embodiments may be employed. It will further be appreciated, that each of the side by side self-defense devices may comprise some, all, or none of the various elements disclosed throughout this disclosure, thus each of the side by side self-defense devices do not necessarily comprise identical elements. For example, one self-defense device may comprise a blade having a serrated edge, while the other self-defense device may comprise a straight edge. Moreover, some embodiments may not comprise one of the side by side self-defense devices to comprise a blade at all, but rather, merely operate to provide greater leverage and/or support for the user operating the other "bladed" self-defense device.

Figure 5:
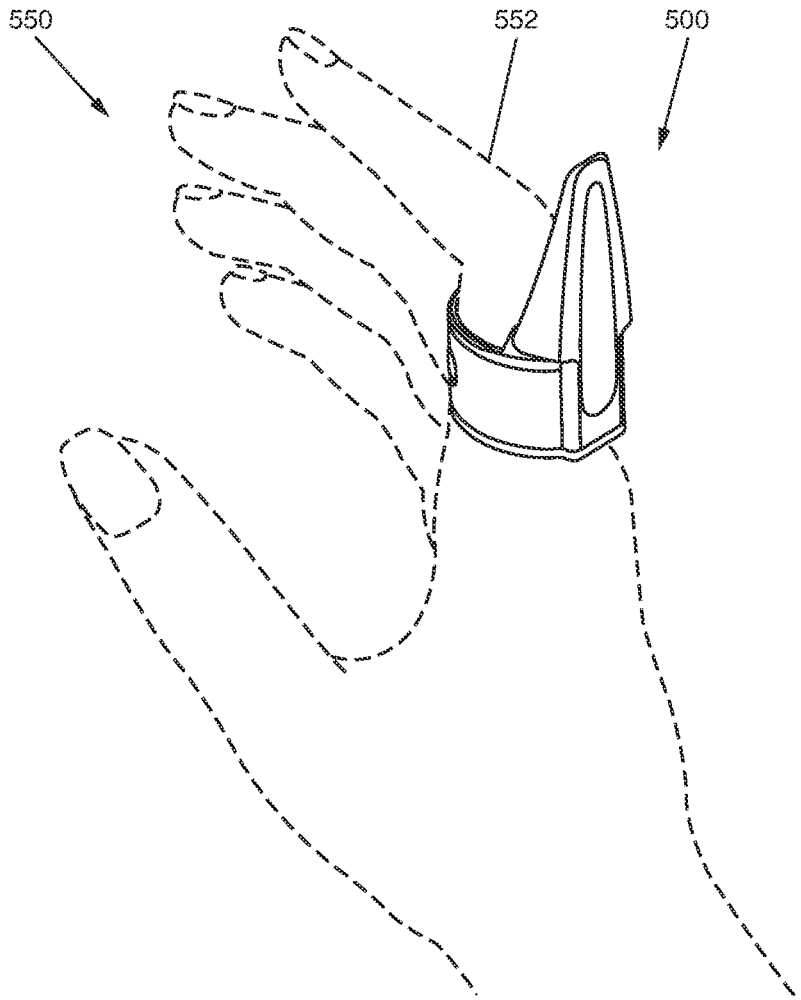
FIG. 5 representatively illustrates a perspective view of an exemplary embodiment of a self-defense device as worn by a user.

With reference to FIG. 5, an exemplary self-defense device 500 is depicted in an exemplary form as worn by a user's hand 550. While device 500 is shown worn on an index finger 552, device 500 may be configured to be worn on any finger. And any multiple ring configurations may be worn by any one, two, three, four, etc. fingers. Although not shown, it will be appreciated by those skilled in the art that a self-defense device or its various elements disclosed herein may be applied to various other wearable jewelry items, such as bracelets, anklets, necklaces, watches, etc.

In accordance with an exemplary embodiment, a method for manufacturing a self-defense device may comprise; providing a ring configured to fit upon a finger of a user, wherein the ring may comprise, an inner diameter and an outer diameter, and a proximate circumferential perimeter and a distal circumferential perimeter, and affixing a blade to and extending from at least a portion of the distal circumferential perimeter of the ring. The method may further comprise, wherein affixing the blade comprises affixing the blade comprising serrated edges. The method may comprise providing a sheath to overlay at least a portion of the blade, a size insert for the ring to effectively reduce the opening, i.e., inner diameter of the ring so as to accommodate a size of the user's finger, and/or providing a support along at least a top side portion of a length of the blade to provide for greater rigidity of the blade. The method of manufacturing the self-defense device may comprise providing a slot to accept a clip to couple multiple self-defense devices, and it may also comprise hinging the blade to the ring to facilitate setting various angles of the blade.

It will be appreciated by those skilled in the art the a method for manufacturing the self-defense device may comprise not only elements detailed in the steps listed above, but may comprise manufacturing the device to comprise some, all, and various permutations of the physical elements detailed throughout this disclosure. Moreover, any methods may further comprise steps for packaging, marketing, distributing, and/or selling the self-defense device as well.

Clearly those skilled in the art will understand that the various self-defense device embodiments shown and described are merely exemplary embodiments and various other configurations may be used to carry out the function of a self-defense device.

In the foregoing specification, a self-defense device has been described with reference to specific exemplary embodiments. Various modifications and changes may be made, however, without departing from the scope of the self-defense device as set forth in the following claims. The specification and Figs. are illustrative, rather than restrictive, and modifications are intended to be included within the scope of the self-defense device. Accordingly, the scope of the self-defense device should be determined by the appended claims and their legal equivalents rather than by merely the exemplary embodiments described.

For example, the steps recited in any method or process claims may be executed in any order and are not limited to the specific order presented in the claims. Additionally, the components and/or elements recited in any device claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" "is" or any variation thereof, are intended to reference a non-exclusive inclusion, such that a process, method, article, device, composition, system, or apparatus that comprises a list of elements does not include only those elements recited, but may also include other elements not expressly listed or inherent to such process, method, article, device, composition, system, or apparatus. Other combinations and/or modifications of the above-described structures, arrangements, applications, proportions, elements, materials or components used in the practice of the self-defense device, in addition to those not specifically recited, may be varied or otherwise particularly adapted to specific environments, manufacturing specifications, design parameters or other operating requirements without departing from the general principles of the same.

I claim:

1. A self-defense device comprising:

a ring sized to fit upon a finger of a user, wherein the ring comprises:

an inner diameter sized to accommodate the user's finger; and a proximate circumferential perimeter and a distal circumferential perimeter;

a fixed blade integral with and extending from at least a portion of the distal circumferential perimeter of the ring, the blade having a radius of curvature about a central axis, wherein the central axis extends through a finger hole formed by the inner diameter of the ring and in a direction parallel with a length of the blade; and a sheath attached to the ring around an exterior surface of the ring and covering the length of the blade, wherein a portion of the sheath covering the blade has a radial contour following the blade, and wherein the portion of the sheath covering the blade is flexibly biasable away from the blade upon insertion of the blade into an object, whereby the portion of the sheath covering the blade is at least partly removed from the blade without a detachment of the sheath from the ring.

2. The self-defense device of claim 1, wherein the blade comprises serrated edges.

3. The self-defense device of claim 1, further comprising a size insert for the ring to effectively reduce the inner diameter of the ring for accommodating the size of the user's finger.

4. The self-defense device of claim 1, comprising a slot to accept a clip to securely couple multiple self-defense devices.

5. The self-defense device of claim 1, wherein the blade comprises a support along at least a top side portion of the length of the blade to provide for greater rigidity of the blade.

6. The self-defense device of claim 1, wherein the blade is affixed and extends from at least a portion of an outer ring width.

7. The self-defense device of claim 1, wherein the blade has substantially straight edges that meet at a vertex located at a distal end of the blade.

8. The self-defense device of claim 1, wherein the portion of the sheath covering the blade is flexibly biasable toward the ring to reveal the blade.

9. The self-defense device of claim 1, wherein the ring is sized to be worn about a proximal phalanx of the finger of a user.

10. A self-defense device comprising:

a wearable jewelry item comprising an integrated fixed blade extending from a distal end of the jewelry item, wherein the blade comprises:

at least one from the group consisting of: a serrated edge, a barb, a prong, and a hooked end;

an elongated support extending along a length of a topside portion of the blade and a topside portion of the jewelry item, wherein the elongated support is fixed to the blade and the jewelry item;

a radius of curvature about a central axis extending, wherein the central axis extends through a hole formed by the jewelry item and in a direction parallel with a length of the blade, and a sheath attached to the ring around an exterior surface of the ring and covering the length of the blade, wherein a portion of the sheath covering the blade has a radial contour following the blade, and wherein the portion of the sheath covering the blade is flexibly biasable away from the blade upon insertion of the blade into an object, whereby the portion of the sheath covering the blade is at least partly removed from the blade without a detachment of the sheath from the ring.

11. The device of claim 10, wherein the jewelry item comprises at least one ring.

12. The method of claim 11, wherein the ring is configured to be worn about a proximal phalanx of the finger of a user.

13. The device of claim 10, further comprising an insert for the ring to accurately size an inner diameter of the ring to the user's finger.

14. A method for manufacturing a self-defense device comprising the following steps:

providing a ring configured to fit upon a finger of a user, wherein the ring comprises;

an inner diameter and an outer diameter, a proximate circumferential perimeter and a distal circumferential perimeter, and an annular groove located substantially around an exterior face of the ring between the proximate circumferential perimeter and the distal circumferential perimeter;

affixing a fixed blade integral with and extending from at least a portion of the distal circumferential perimeter of the ring, the blade having a radius of curvature about a central axis, wherein the central axis extends through a finger hole formed by the inner diameter of the ring and in a direction parallel with a length of the blade; and providing a sheath attached to the ring around an exterior surface of the ring and covering the length of the blade, wherein a portion of the sheath covering the blade has a radial contour following the blade, and wherein the portion of the sheath covering the blade is flexibly biasable away from the blade upon insertion of the blade into an object, whereby the portion of the sheath covering the blade is at least partly removed from the blade without a detachment of the sheath from the ring.

15. The method of claim 14, wherein affixing the blade comprises affixing the blade comprising serrated edges.

16. The method of claim 14, wherein a portion of the sheath covering the ring is positioned in the annular groove.

17. The method of claim 14, further comprising providing a size insert for the ring to effectively reduce the inner diameter of the ring to accommodate a size of the user's finger.

18. The method of claim 14, further comprising providing a slot to accept a clip to couple multiple self-defense devices.

19. The method of claim 14, further comprising providing an elongated support extending along at least a topside portion of a length of the blade and a topside portion of the ring, wherein the elongated support is fixed to the blade and the ring.

* * * * *